US011506015B2

(12) United States Patent
Casanova

(10) Patent No.: US 11,506,015 B2
(45) Date of Patent: Nov. 22, 2022

(54) TOP DOWN CEMENT PLUG AND METHOD

(71) Applicant: Gabriel Casanova, Spring, TX (US)

(72) Inventor: Gabriel Casanova, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/091,682

(22) Filed: Nov. 6, 2020

(65) Prior Publication Data

US 2022/0145722 A1 May 12, 2022

(51) Int. Cl.

| | |
|---|---|
| ***E21B 33/14*** | (2006.01) |
| ***E21B 33/12*** | (2006.01) |
| *E21B 37/10* | (2006.01) |

(52) U.S. Cl.
CPC ..... *E21B 33/14* (2013.01); *E21B 33/1204* (2013.01); *E21B 37/10* (2013.01)

(58) Field of Classification Search
CPC ..... E21B 33/16; E21B 33/14; E21B 33/126
See application file for complete search history.

(56) References Cited

U.S. PATENT DOCUMENTS

| | | | | |
|---|---|---|---|---|
| 3,185,218 | A * | 5/1965 | Hoch | E21B 33/14 166/156 |
| 5,829,526 | A * | 11/1998 | Rogers | E21B 23/00 166/291 |
| 7,228,897 | B2 * | 6/2007 | Holt, Jr. | E21B 21/103 166/177.4 |
| 9,404,358 | B2 * | 8/2016 | Steele | E21B 47/024 |
| 10,648,272 | B2 * | 5/2020 | Budde | E21B 33/14 |
| 11,193,350 | B2 * | 12/2021 | Kuo | E21B 43/26 |
| 2004/0104025 | A1 * | 6/2004 | Mikolajczyk | E21B 33/16 166/153 |
| 2012/0234561 | A1 * | 9/2012 | Hall | E21B 33/12 166/386 |
| 2013/0168098 | A1 * | 7/2013 | Campbell | E21B 43/26 166/308.1 |
| 2014/0034310 | A1 * | 2/2014 | Andersen | E21B 43/26 166/281 |
| 2015/0083410 | A1 * | 3/2015 | Steele | E21B 47/024 166/255.3 |
| 2015/0129212 | A1 * | 5/2015 | Noe | E21B 43/267 166/280.2 |
| 2015/0376960 | A1 * | 12/2015 | Rodrigue | E21B 33/14 166/285 |
| 2016/0084075 | A1 | 3/2016 | Ingrham et al. | |

(Continued)

FOREIGN PATENT DOCUMENTS

| | | |
|---|---|---|
| EP | 3049608 B1 | 8/2016 |
| WO | 2016018429 A1 | 2/2016 |

OTHER PUBLICATIONS

Notification of Transmittal of the International Search Report and the Written Opinion of the International Searching Authority, or the Declaration; PCT/US2021/05755; dated Feb. 18, 2022: 9 pages.

*Primary Examiner* — Shane Bomar
(74) *Attorney, Agent, or Firm* — Cantor Colburn LLP

(57) ABSTRACT

A cementing plug including a wiper portion, an engagement section attached to the wiper portion, the engagement section including an engagement feature configured to release at a selected threshold pressure related to cement forming an annular structure about a fracturing device.

14 Claims, 6 Drawing Sheets

(56) References Cited

U.S. PATENT DOCUMENTS

| | | | | |
|---|---|---|---|---|
| 2018/0023362 | A1 | 1/2018 | Makowiecki et al. | |
| 2018/0030828 | A1* | 2/2018 | Budler | E21B 33/16 |
| 2020/0270960 | A1 | 8/2020 | Watkins et al. | |

* cited by examiner

TOP DOWN CEMENT PLUG AND METHOD

BACKGROUND

In the resource recovery industry subsurface resource recovery equipment and structures are generally long-term installations. Over time, it may be necessary to update structures or techniques to ensure productive recovery. In one example, older fracked wells may need to be refracked to increase productivity. It may be that the original frac plan was by later standards insufficient or just that over time, production has waned. In any event, the refracking process is time consuming and expensive. In view of the importance of refracking, operators would well appreciate an apparatus and method for reducing the business impact of the refracking operation.

SUMMARY

An embodiment of a cementing plug including a wiper portion, an engagement section attached to the wiper portion, the engagement section including an engagement feature configured to release at a selected threshold pressure related to cement forming an annular structure about a fracturing device.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
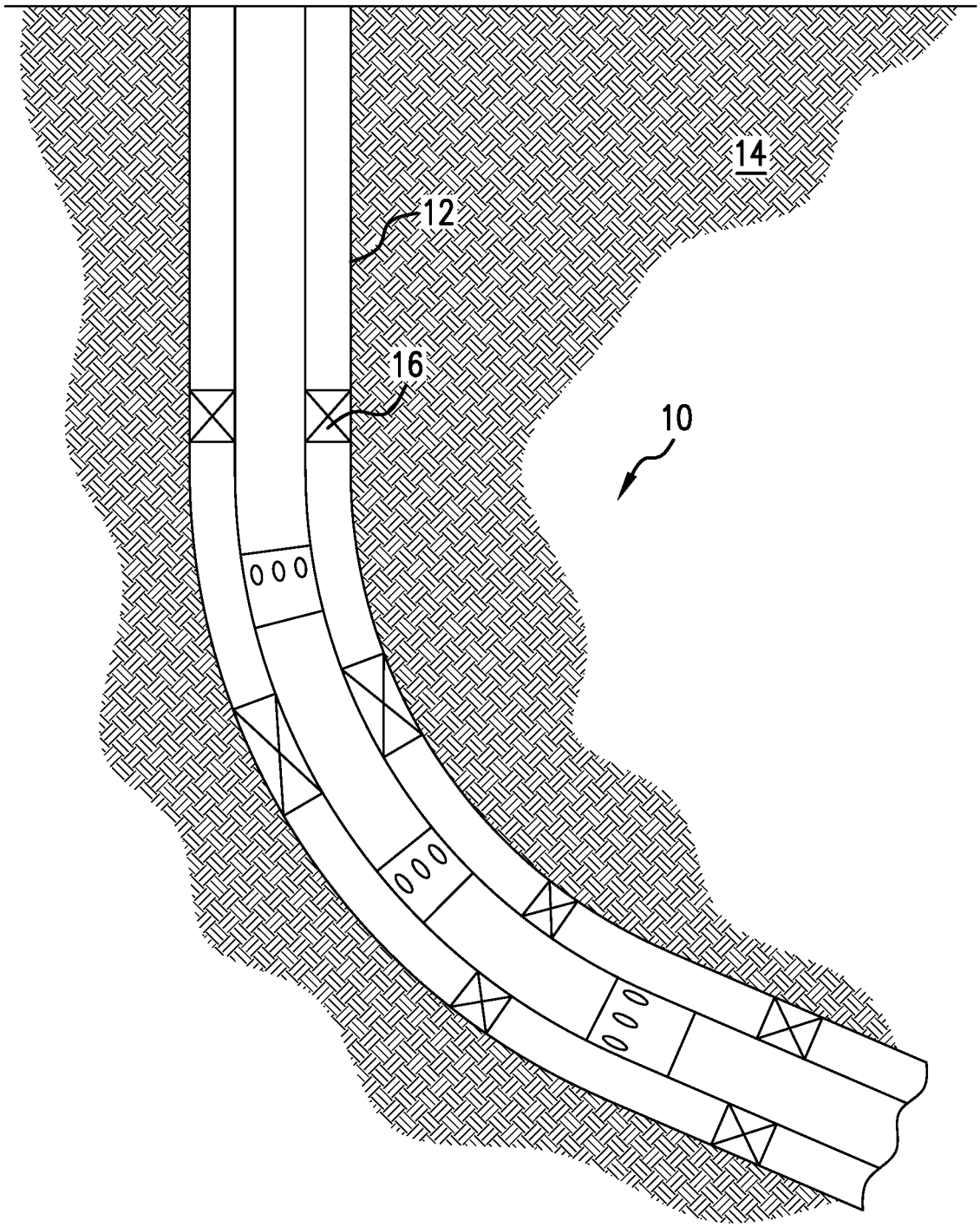
FIG. 1 PRIOR ART
FIG. 1 is a schematic representation of a prior art wellbore system having drilled out frac devices therein.

Referring to FIG. 1, a prior art open hole and fractured wellbore is illustrated at 10. As will be familiar to those skilled in the art, a borehole 12 extends into a subsurface formation 14. A plurality of external casing packers 16 are illustrated as well as a plurality of fracturing devices 18 after they have been drilled out following an original fracturing operation. As will be appreciated, the well has been run in this condition for a number of years. When refracturing is desired however, this is the condition from which an operator will start to refracture the well.

Figure 2:
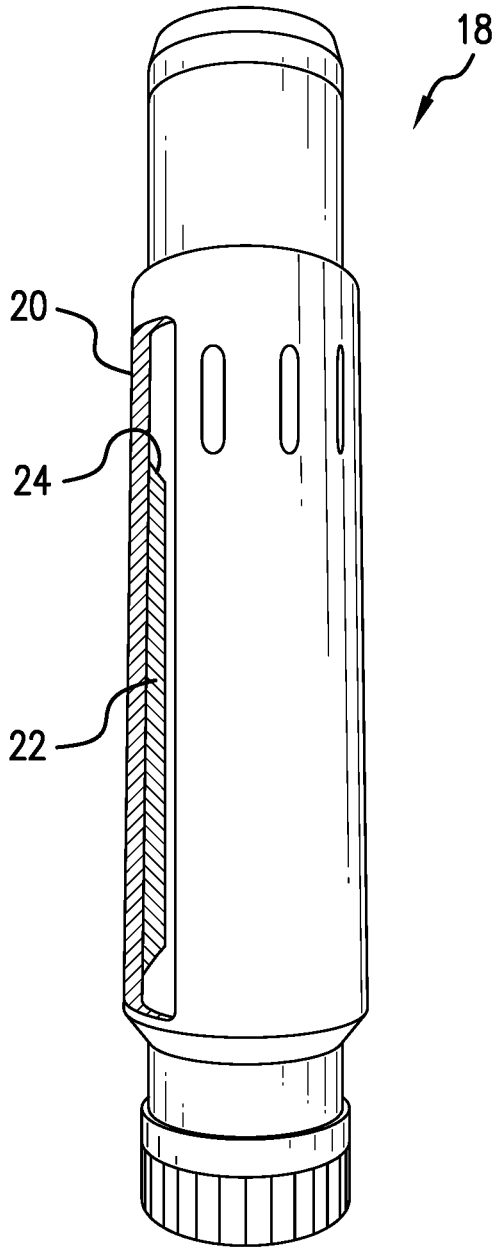
FIG.2 PRIOR ART
FIG. 2 is an enlarged view of one of the prior art drilled out frac devices illustrating a shoulder and ports.

Referring to FIG. 2, one will recognize a fracture device 18 illustrated with an opening in a wall 20 thereof to illustrate a sleeve 22 and shoulder 24 that are left after a drilling operation. The shoulder presents a landing and locating spot that can be leveraged to support the inventive method and apparatus for top down cementing as disclosed herein.

Figure 3:
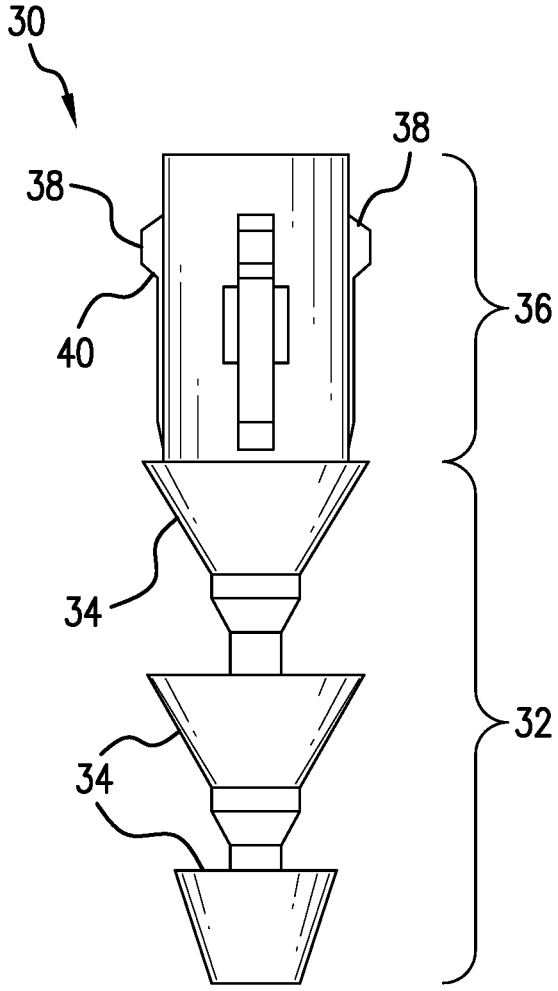
FIG. 3 is a schematic view of the cement plug as disclosed herein.
Figure 4:
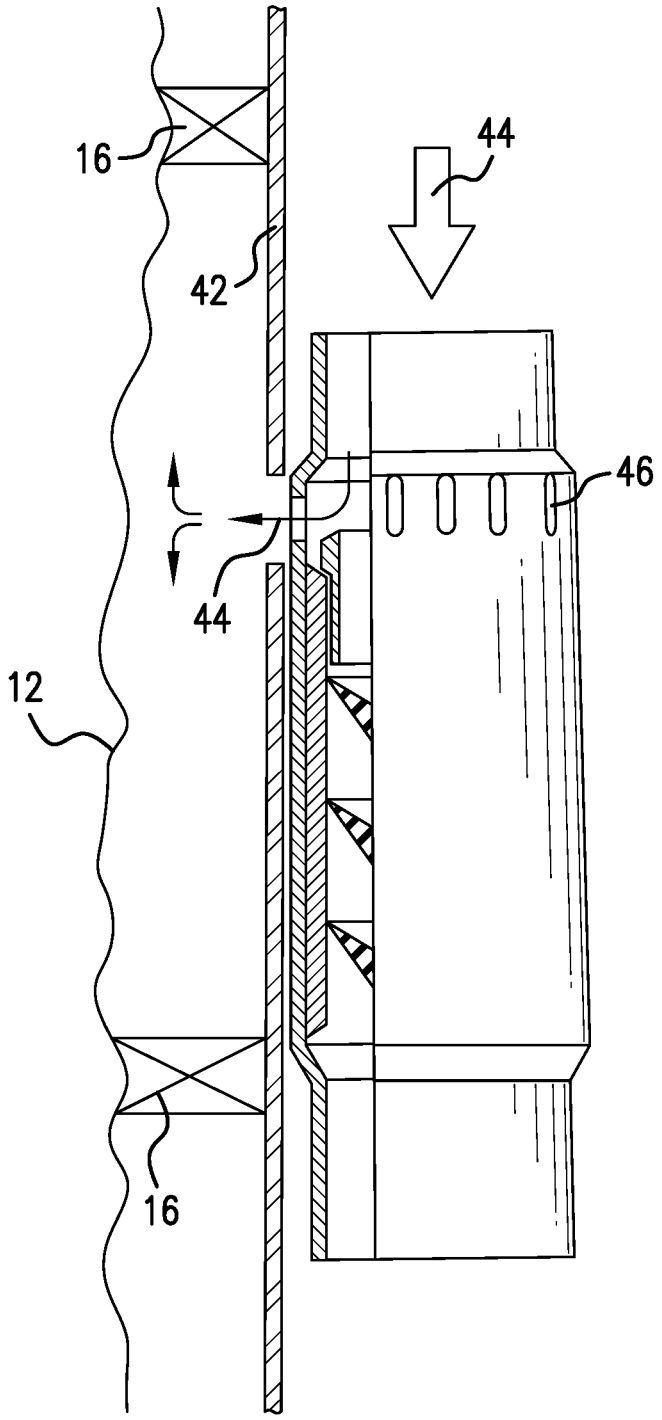
FIG. 4 is a view of a portion of the wellbore with a cementing operation in process using the apparatus and method as disclosed herein.
Figure 5:
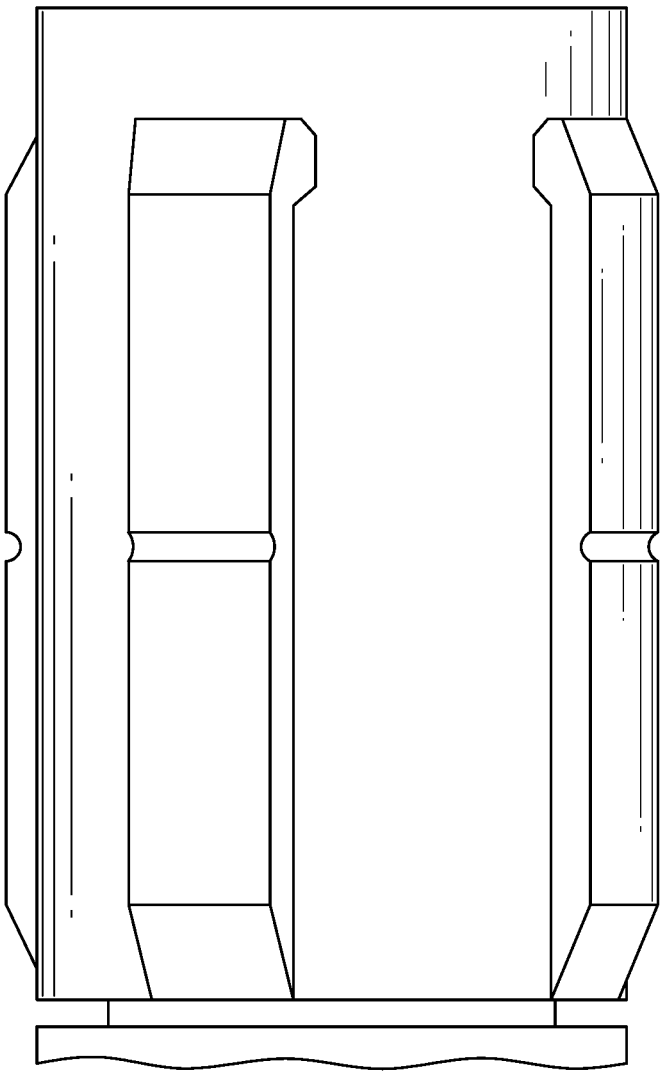
FIG. 5 is a view of a drag block.
Figure 6:
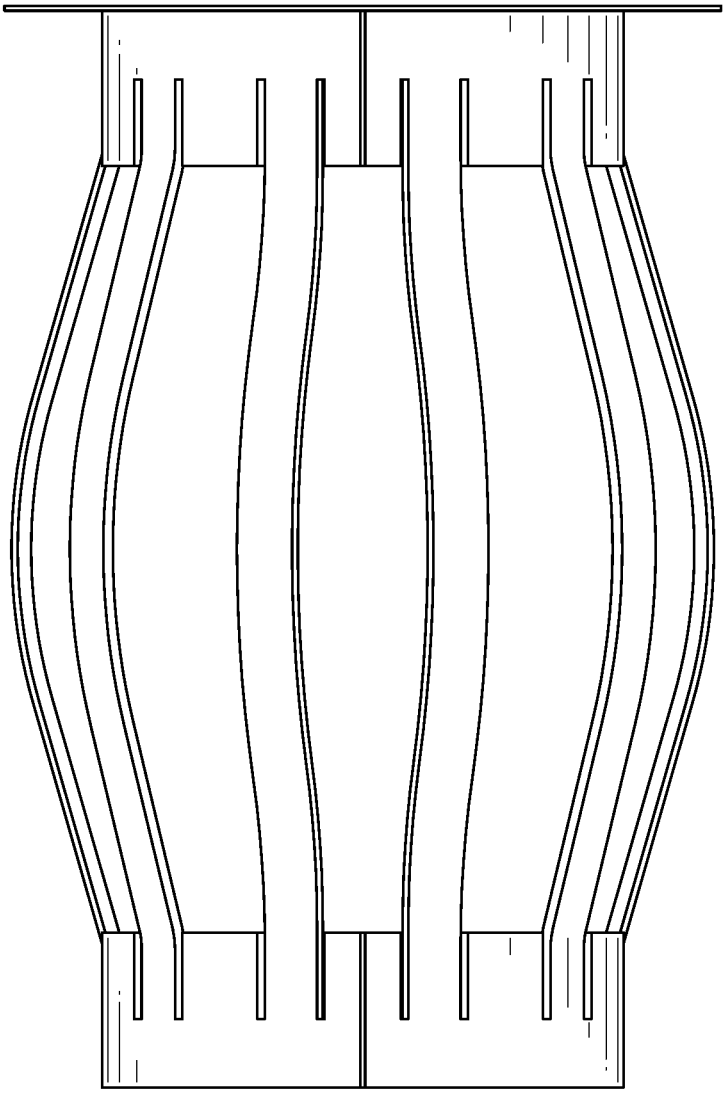
FIG. 6 is a view of a bow spring.

Referring to FIG. 3, a cement plug 30 is illustrated comprising a wiper portion 32 that is illustrated with three wipers 34 but more or fewer are contemplated. The plug 30 further includes an engagement section 36. Engagement section 36 is configured to employ an engagement feature 38 to land on and in some way releasably engage the shoulder 24. By "releasably engage", it is meant that the engagement will hold fast until a selected trigger occurs such as a pressure threshold whereafter the engagement section 36 will release and allow the plug 30 to continue downhole to the next adjacent sleeve 22 and start the process again. The engagement section may be embodied as a collet, a drag block (FIG. 5), a bow spring (FIG. 6), a set of dog profiles, and other arrangements that allow for location at a specific feature such as the shoulder 24. As illustrated, the engagement section 36 is embodied as a collet device wherein the engagement feature 38 is a number of collet fingers disposed therearound that present a feature face 40. The feature face 40 is angled and dimensioned to interact with the shoulder 24 of the frac device 18. More specifically, when refracture is needed, the first part of the process is to recement the wellbore. The cement plug is introduced into the borehole 12 in an original casing 42 and followed by cement slurry 44 from surface. When the cement plug 30 reaches one of the fracture devices 18, the feature face 40 lands upon the shoulder 24 thereby halting downhole movement of the cement plug 30. The sleeve 22 remains locked in place in a position it was given during its first fracture job. In this condition and prior to cement pressure reaching a selected pressure threshold that is selected for each job (for example, 1000 PSI), the cementing plug 30 will maintain position and cause the cement slurry 44 to exit the casing 42 through ports 46 of the frac device 18. Cement slurry 44 will continue to move into the area illustrated creating a fully annular cement sleeve around the device 18 following which pressure exerted from surface will being to rise. When pressure is at the threshold value, which has been selected to indicate that the volume of cement squeezed into the area illustrated in the FIG. 4, is sufficient, the cementing plug 30 will again move to find the next further downhole device 18 and start the process again. This occurs due to the configuration of the engagement section 36 of the plug 30. The engagement features 38, here illustrated as collet fingers, are constructed to be rigid enough in their engaged position that they will hold a load up to the threshold value selected and then to deflect allowing the plug 30 to pass the restriction and move to the next one. It should be appreciated that the configuration as taught ensures that cement is actually delivered to a selected pressure in each of the prefractured areas of the well. This result with prior art methods could not be relied upon. Once the threshold is reached, the cementing plug 30 automatically finds the next downhole frac device 18 and starts the process again filling the space (another space just like the one illustrated) with cement slurry 44 until the pressure exceeds the threshold value and the plug 30 once again moves. This sequence is repeatable any number of times until the plug 30 reaches the toe of the well and is physically prevented from moving farther. At this point, the entirety of the well is recemented and ready for a refracturing job in any of the traditional ways.

The disclosure provides great benefit to the art since the cementing operation as described is simple, fast and requires no input from surface other than pumping cement. The method is also top down, meaning the first portion of the well to be recemented is at the uphole most extent of the fracturing devices. This makes the process fast and automatically directs the full pressure of the pumped cement to a specific fracturing device and formation surrounding it rather than allowing the cement pressure to be spread over a number of devices at once. This ensures a best case cementing of the annular space around the fracturing device. In the event a particular zone does not experience pressure increase while cementing, the operation may be paused the cement column and plug 30 drilled out and the operation restarted with a new cement plug 30. To facilitate this action and to remove the plug after the recementing is complete if desired, it is contemplated to form the plug 30 from easily drillable materials or degradable materials such as a controlled electrolytic material available from Baker Hughes, Houston Tex.

Set forth below are some embodiments of the foregoing disclosure:

Embodiment 1: A cementing plug including a wiper portion, an engagement section attached to the wiper portion, the engagement section including an engagement feature configured to release at a selected threshold pressure related to cement forming an annular structure about a fracturing device.

Embodiment 2: The plug as in any prior embodiment, wherein the engagement feature includes a feature face configured to interact with a shoulder of the fracturing device.

Embodiment 3: The plug as in any prior embodiment, wherein the selected threshold pressure is that pressure calculated for a particular well to fill an annular space defined between the fracture device and a borehole wall.

Embodiment 4: The plug as in any prior embodiment, wherein the engagement feature releases when cement pressure against the plug reaches about 1000 psi.

Embodiment 5: The plug as in any prior embodiment, wherein the engagement section comprises a collet.

Embodiment 6: The plug as in any prior embodiment, wherein the engagement section comprises a drag block.

Embodiment 7: The plug as in any prior embodiment, wherein the engagement section comprises a bow spring.

Embodiment 8: A wellbore including a formation, a borehole in the formation, a plug as in any prior embodiment, disposed in the borehole.

Embodiment 9: A method for cementing an existing wellbore including running a plug, as in any prior embodiment, into a borehole of the wellbore, pumping cement into the borehole behind the plug, landing the plug in a drilled out fracturing device, squeezing cement through ports of the drilled out fracturing device.

Embodiment 10: The method as in any prior embodiment, wherein the landing is on a shoulder of a sleeve of the drilled out fracturing device.

Embodiment 11: The method as in any prior embodiment, wherein the cementing is top down.

Embodiment 12: The method as in any prior embodiment, further comprising automatically deflecting the collet finger upon the cement reaching the selected threshold pressure.

Embodiment 13: The method as in any prior embodiment, further comprising conveying the plug to the next adjacent drilled out fracturing device.

Embodiment 14: The method as in any prior embodiment, wherein the method is carried out automatically upon achieving the selected threshold pressure in the cement.

Embodiment 15: The method as in any prior embodiment, wherein the method further comprises drilling the plug out if the selected pressure threshold is not reached and running a new plug to restart the method.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A cementing plug comprising:

a wiper portion;

an engagement section attached to the wiper portion, the engagement section including an engagement feature having a feature face, the same feature face configured to engage and then release shoulders of sequential fracturing devices in a borehole, the release occurring at a selected threshold pressure related to cement forming an annular structure about individual ones of the sequential fracturing devices.

2. The plug as claimed in claim 1 wherein the selected threshold pressure is that pressure calculated for a particular well to fill an annular space defined between the fracture device and a borehole wall.

3. The plug as claimed in claim 1 wherein the engagement feature releases when cement pressure against the plug reaches about 1000 psi.

4. The plug as claimed in claim 1 wherein the engagement section comprises a collet.

5. The plug as claimed in claim 1 wherein the engagement section comprises a drag block.

6. The plug as claimed in claim 1 wherein the engagement section comprises a bow spring.

7. A wellbore comprising:

a formation;

a borehole in the formation;

a plug as claimed in claim 1 disposed in the borehole.

8. A method for cementing an existing wellbore comprising:

running a plug having a wiper portion;

an engagement section attached to the wiper portion, the engagement section including an engagement feature configured to release at a selected threshold pressure related to cement forming an annular structure about a fracturing device into a borehole of the wellbore;

pumping cement into the borehole behind the plug;

landing the plug in a drilled out fracturing device; and squeezing cement through ports of the drilled out fracturing device.

9. The method as claimed in claim 8 wherein the landing is on a shoulder of a sleeve of the drilled out fracturing device.

10. The method as claimed in claim 8 wherein the cementing is top down.

11. The method as claimed in claim 8 further comprising automatically deflecting a collet finger upon the cement reaching the selected threshold pressure.

12. The method as claimed in claim 11 further comprising conveying the plug to the next adjacent drilled out fracturing device.

13. The method as claimed in claim 8 wherein the method is carried out automatically upon achieving the selected threshold pressure in the cement.

14. The method as claimed in claim 8 wherein the method further comprises drilling the plug out if the selected pressure threshold is not reached and running a new plug to restart the method.

* * * * *